US008808484B2

(12) United States Patent
Lynch et al.

(10) Patent No.: US 8,808,484 B2
(45) Date of Patent: Aug. 19, 2014

(54) METHOD OF MANUFACTURING A UNIVERSAL DOOR SKIN BLANK

(75) Inventors: Steven K. Lynch, St. Charles, IL (US); Bei-Hong Liang, Naperville, IL (US); Mark A. Ruggie, Franklin Park, IL (US); Jason Walsh, St. Charles, IL (US); Henry Coghlan, St. Charles, IL (US)

(73) Assignee: Masonite Corporation, Tampa, FL (US)

( * ) Notice: Subject to any disclaimer, the term of this patent is extended or adjusted under 35 U.S.C. 154(b) by 30 days.

(21) Appl. No.: 13/419,068

(22) Filed: Mar. 13, 2012

(65) Prior Publication Data

US 2012/0227345 A1 Sep. 13, 2012

Related U.S. Application Data

(60) Continuation of application No. 11/503,975, filed on Aug. 15, 2006, now Pat. No. 8,133,340, which is a division of application No. 10/291,756, filed on Nov. 12, 2002, now Pat. No. 7,137,232.

(51) Int. Cl.
*E06B 3/78* (2006.01)
*E06B 3/70* (2006.01)

(52) U.S. Cl.
CPC ..... *E06B 3/7001* (2013.01); *E06B 2003/7061* (2013.01); *E06B 3/78* (2013.01)
USPC ..... 156/219; 156/222; 52/309.9; 52/455; 52/784.1

(58) Field of Classification Search
None
See application file for complete search history.

(56) References Cited

U.S. PATENT DOCUMENTS

| | | | |
|---|---|---|---|
| 24,558 | A | 6/1859 | Tyree |
| 653,400 | A | 7/1900 | Rapp |
| 1,570,310 | A | 1/1926 | Ljungberg et al. |
| 1,810,321 | A | 12/1927 | Michelman |
| D77,542 | S | 1/1929 | Gaston |
| 2,692,450 | A | 10/1954 | Reinemer |
| 2,765,056 | A | 10/1956 | Tyree |
| 2,889,594 | A | 6/1959 | Feuerborn |
| D192,724 | S | 5/1962 | Jackson |
| 3,287,855 | A | 11/1966 | Hallonquist et al. |
| 4,072,548 | A | 2/1978 | Gerson et al. |
| 4,084,996 | A | 4/1978 | Wheeler |

(Continued)

FOREIGN PATENT DOCUMENTS

| | | | |
|---|---|---|---|
| DE | 3423252 | A1 | 1/1986 |
| DE | 19721465 | C1 | 10/1998 |
| FR | 2514401 | A1 | 4/1983 |
| GB | 2289439 | A | 11/1995 |

OTHER PUBLICATIONS

Interior Doors by Curtis, Catalog 500, Curtis Companies, Inc. 1927, p. 12.

*Primary Examiner* — Barbara J Musser
(74) *Attorney, Agent, or Firm* — Berenato & White, LLC

(57) ABSTRACT

A universal door skin blank comprises an exterior side and an interior side for securing to a frame member, first and second molded, spaced stiles, and a flat planar portion disposed between the stiles and lying on a plane spaced from the plane of the stiles. An interface portion is disposed between and contiguous with the stiles and the flat planar portion. The invention also relates to a door having at least one universal door skin blank, with at least two separately formed rails secured to the planar portion of the blank at opposite ends thereof.

19 Claims, 14 Drawing Sheets

(56) References Cited

U.S. PATENT DOCUMENTS

| | | | | | |
|---|---|---|---|---|---|
| 4,236,365 | A | | 12/1980 | Wheeler | |
| 4,265,067 | A | | 5/1981 | Palmer | |
| 4,271,892 | A | | 6/1981 | Brusseau et al. | |
| 4,546,585 | A | | 10/1985 | Governale | |
| 4,702,054 | A | * | 10/1987 | Turner | 52/455 |
| 4,743,509 | A | | 5/1988 | Vladimiro | |
| 4,756,350 | A | | 7/1988 | Turner | |
| 4,812,188 | A | | 3/1989 | Hansen | |
| 4,844,968 | A | | 7/1989 | Persson et al. | |
| 4,882,877 | A | | 11/1989 | Guetle et al. | |
| 5,022,206 | A | | 6/1991 | Schield | |
| 5,074,087 | A | | 12/1991 | Green | |
| 5,540,026 | A | * | 7/1996 | Gartland | 52/455 |
| 5,568,713 | A | | 10/1996 | Gagne et al. | |
| 5,887,402 | A | | 3/1999 | Ruggie et al. | |
| 5,946,873 | A | | 9/1999 | Schiedegger et al. | |
| 6,073,419 | A | | 6/2000 | Moyes | |
| 6,079,183 | A | | 6/2000 | Moyes | |
| 6,312,540 | B1 | * | 11/2001 | Moyes | 156/87 |
| 6,389,768 | B1 | * | 5/2002 | Gagne et al. | 52/309.9 |
| 6,485,800 | B1 | | 11/2002 | Littschwager et al. | |
| 6,487,827 | B2 | | 12/2002 | Hollman | |
| 6,602,610 | B2 | | 8/2003 | Smith et al. | |
| 7,137,232 | B2 | | 11/2006 | Lynch et al. | |
| 7,284,352 | B2 | | 10/2007 | Lynch et al. | |
| 7,370,454 | B2 | | 5/2008 | Lynch et al. | |
| 7,964,051 | B2 | | 6/2011 | Lynch et al. | |
| 8,133,340 | B2 | | 3/2012 | Lynch et al. | |
| 8,677,707 | B2 | | 3/2014 | Lynch et al. | |
| 2001/0029714 | A1 | * | 10/2001 | Lynch et al. | 52/309.13 |
| 2002/0083649 | A1 | | 7/2002 | Hollman | |
| 2003/0066257 | A1 | | 4/2003 | Shovlin | |
| 2003/0115817 | A1 | | 6/2003 | Blackwell et al. | |
| 2003/0226328 | A1 | | 12/2003 | West et al. | |
| 2004/0074186 | A1 | | 4/2004 | Lynch et al. | |

* cited by examiner

METHOD OF MANUFACTURING A UNIVERSAL DOOR SKIN BLANK

CROSS-REFERENCE TO RELATED APPLICATION AND CLAIM TO PRIORITY

This application is a continuation of U.S. patent application 11/503,975, filed Aug. 15, 2006, now U.S. Pat. No. 8,133,340, which is a divisional of U.S. patent application Ser. No. 10/291,756, filed Nov. 12, 2002, now U.S. Pat. No. 7,137,232, the disclosures of which are herein incorporated by reference, and to which priority is claimed.

FIELD OF THE INVENTION

The present invention relates to a universal door skin blank, comprising a wood composite blank molded to have spaced stiles lying on a first plane and a flat planar portion disposed between the stiles and lying on a plane spaced from the plane of the stiles. A decorative layer, such as a veneer, foil, or paper overlay, may be secured to the blank during formation of the universal door skin blank. An interface portion is disposed between and contiguous with the stiles and the planar portion, and is preferably formed at a 45° angle. At least two separately formed rails may be adhesively secured to the blank at opposite ends of the planar portion. The present invention also relates to a door having a peripheral frame with oppositely disposed sides, and first and second door skins, each skin having an exterior side and an interior side secured to one of the frame sides. At least one of the skins is a universal door skin blank, with rails attached thereto.

BACKGROUND ON THE INVENTION

The formation of a molded door skin from a flat wood composite, and a hollow core door manufactured therewith, is known in the art. For example, see Moyes, U.S. Pat. No. 6,312,540 and Moyes, U.S. Pat. No. 6,079,183, the disclosures of which are incorporated herein by reference. The wood composite may be particleboard, flake board, hard board, or medium density fiberboard ("MDF"). The wood composites often utilize a resin binder, which frequently is a thermal setting resin, in order to maintain the wood fibers forming the composite in solid form.

Standard molded door skins are formed from a relatively thick non-solid mat or bat of material, which is thereafter compressed in a press to a relatively thin, final thickness. The mat is in a flexible state prior to the pressing operation, and the resulting solid skin may have sharply defined features because the wood fibers conform to the shape of the dies under heat and pressure. Standard molded door skins may provide contoured features desirable to consumers, but are relatively expensive to manufacture due to the tooling costs.

A flush door skin is one that is flat or planar on both major surfaces. Such skins are less expensive to manufacture than standard molded skins. A wood composite flush door skin blank may be transformed into a molded skin by post-forming the flush door skin, as disclosed in the above referenced patents to Moyes. Thus, contoured features may be achieved using a flat blank by subsequently post-forming the blank to a desired contour.

A molded door skin may include features simulating stiles, rails and panels. Such features are desirable to consumers. Contoured features and wood grain textures may be pressed into the blank during compression. However, a different die set is required for different panel and door configurations. For example, the die set used to form a molded door skin having two simulated panels between the stiles may not be used to form a molded door skin having three or more simulated panels between the stiles. In addition, a new die set is required for different length door skins, even if the panel configuration is similar, given the panel dimensions are different.

With conventional molded door skins, the veneers and overlays applied to such skins do not provide an appearance of having separate stiles and rails. This is because the pattern of the veneer or overlay, such as a paper overlay, foil, or the like, is oriented in one direction on the entire visible surface of the door skin. In that event, the wood grain pattern runs parallel to the stiles, but perpendicular to the rails because the rails and stiles are oriented at a 90° angle. Therefore, the door does not present an appearance of being a solid hardwood door having separate stiles and rails, which is desirable to consumers.

In an attempt to overcome this problem, some methods provide for positioning separate pieces of veneer or paper overlay, so that the pattern on the veneer or overlay may be oriented as desired. For example, pieces of veneer corresponding to the size of the rails are positioned on the blank at positions corresponding to the rails. However, the overlays must be carefully aligned, thereby increasing time and cost in door manufacture. Furthermore, even if the overlay is properly aligned, the overlay may not be secured onto the blank consistently. In addition, a specific die set for molding the blanks is required for each door skin configuration.

In one attempt to provide a door having an appearance of separate stiles and rails, a groove is routed from a main panel, forming stiles and a raised infill panel. Rails are then secured to receiving surfaces adjacent the simulated raised infill panel. Although the appearance of the door produced therefrom is improved, it is not cost efficient. The rails are positioned on predetermined receiving surfaces adjacent the raised infill panel. Therefore, any variations in panel configuration require that a new blank and routing pattern be utilized. If the main panel is molded, multiple die sets are again required for multiple panel configurations. Therefore, such a method does not solve the manufacturing and inventory problems noted above.

Therefore, it is an object of the present invention to provide a universal door skin blank that is inexpensive to manufacture, and that solves the above noted problems. It is a further object of the present invention to provide a universal door skin blank that may be used for various panel and/or rail configurations.

SUMMARY OF THE INVENTION

A universal door skin blank comprises an exterior side and an interior side for being secured to a frame member, first and second molded, spaced stiles, and a flat planar portion disposed between the stiles and lying on a plane spaced from the plane of the stiles. An interface portion is disposed between and contiguous with the stiles and the flat planar portion.

The present invention also relates to a door having at least one universal door skin blank. The door comprises a peripheral frame having oppositely disposed sides and first and second door skins. Each one of the skins has an exterior side and an interior side secured to one of the frame sides. At least one of the skins is formed to have spaced stiles lying on a first plane and a planar portion disposed between the stiles and lying on a plane spaced from the plane of the stiles. At least two separately formed rails are secured to the planar portion at opposite ends thereof.

A method of producing a door is provided, comprising the steps of: providing a peripheral door frame having oppositely disposed sides; providing first and second wood composite blanks having an exterior side and an interior side; forming at least one of the blanks to have spaced stiles, a planar portion disposed between the stiles and lying on a plane spaced from the plane of the stiles, and an interface portion disposed between and contiguous with the stiles and the planar portion; securing the interior sides of the formed blanks to one of the frame sides; forming at least two rails, each one of the rails having an exterior surface and an interior surface; and securing the interior surface of the rails onto the planar portion.

A method of producing a universal door skin blank is also provided, comprising the steps of: providing a die set having an upper die spaced from a lower die, the dies creating a forming chamber defining first and second spaced stiles lying on a first plane, and a planar portion lying on a second plane spaced from the first plane and the planar portion being integral with and disposed between the stiles; disposing a substrate between the upper and lower dies; and compressing the substrate using heat and pressure to form a blank having first and second molded, spaced stiles, and a flat planar portion disposed between the stiles and lying on a plane spaced from the plane of the stiles.

DETAILED DESCRIPTION OF THE INVENTION

Figure 1:
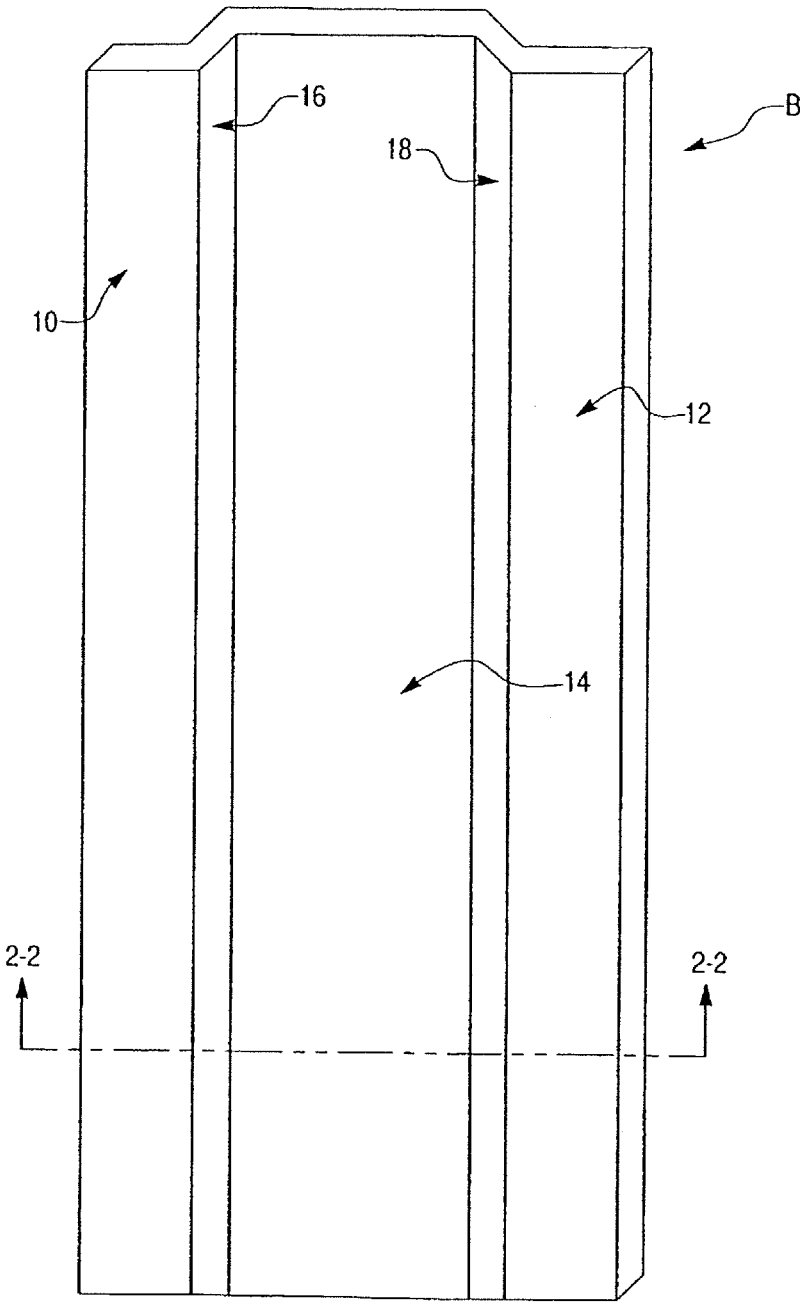
FIG. 1 is an elevational view of a universal door skin blank according to the present invention.
Figure 2:
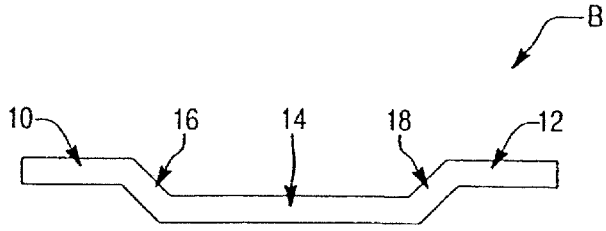
FIG. 2 is a cross-sectional view taken along the line 2-2 of FIG. 1 and viewed in the direction of the arrows.

As best shown in FIGS. 1-2, a universal door skin blank B is formed to have oppositely disposed molded stiles 10, 12 lying on a first plane, and a flat planar portion 14 disposed between and integral with stiles 10, 12 and lying on a plane spaced from the plane of stiles 10, 12. Preferably, stiles 10, 12 are parallel and coplanar, and extend along the opposing sides of blank B. A standard width of stiles 10, 12 is about 152.4 millimeters (or about 6 inches). Planar portion 14 extends the entire length of stiles 10, 12, and maintains a substantially constant width between stiles 10, 12 the entire length of blank B.

Preferably, planar portion 14 is recessed relative to stiles 10, 12 by about 6 to 9 millimeters, though any desired spacing between the plane of stiles 10, 12 and the plane of planar portion 14 may be formed. Blank B may be post-formed from a solid composite wood blank, such as an MDF blank. Alternatively, blank B may be formed from a non-solid bat of material, as known in the art. Any known method of forming blank B may be utilized, so long as blank B is formed to have spaced stiles 10, 12 and planar portion 14, as described herein. Additionally, blank B may be fiberglass, thermoplastic, or any other suitable material.

An interface 16 is disposed between and contiguous with stile 10 and planar portion 14, as best shown in FIGS. 1-2. Likewise, an interface 18 is disposed between and contiguous with stile 12 and planar portion 14. Interfaces 16, 18 preferably extend at an angle of 45° relative to the plane of planar portion 14. However, it is understood that interfaces 16, 18 may be formed to extend at any desired angle during formation of blank B.

Figure 3:
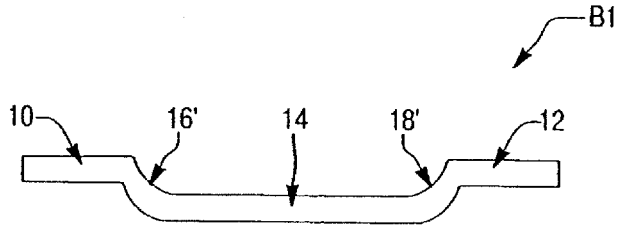
FIG. 3 is a cross-sectional view similar to FIG. 2 showing a second embodiment of the interface portion between the stiles and planar portion.
Figure 4:
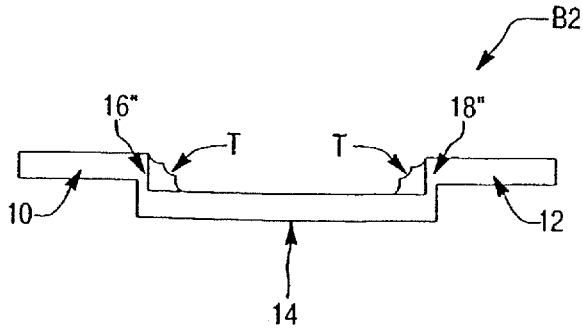
FIG. 4 is a cross-sectional view similar to FIG. 2 showing a third embodiment of the interface portion between the stiles and planar portion.

Interfaces 16, 18 may include a contoured design, such as a curved portion or descending step portion disposed between stiles 10, 12 and planar portion 14, respectively. For example, blank B1 may be formed to have curved interfaces 16' and 18', as best shown in FIG. 3. Alternatively, blank B2 may be formed to have interfaces 16" and 18" extending at an angle of 90° relative to the plane of planar portion 14, as best shown in FIG. 4. Note that identical features are numbered accordingly. Therefore, interfaces 16", 18" are perpendicular to planar portion 14 as well as to stiles 10, 12. This configuration may be advantageous if a decorative mold trim T or bond trim is secured to interfaces 16", 18", and mold trim T has an L-shaped surface for securing to planar portion 14 and interfaces 16", 18", as best shown in FIG. 4. Of course, trim T may be secured to interfaces 16, 18 or 16', 18', depending on the configuration of trim T. Additionally, trim T may extend above the plane of stiles 10, 12, depending on the configuration of trim T and consumer preference.

Figure 5:
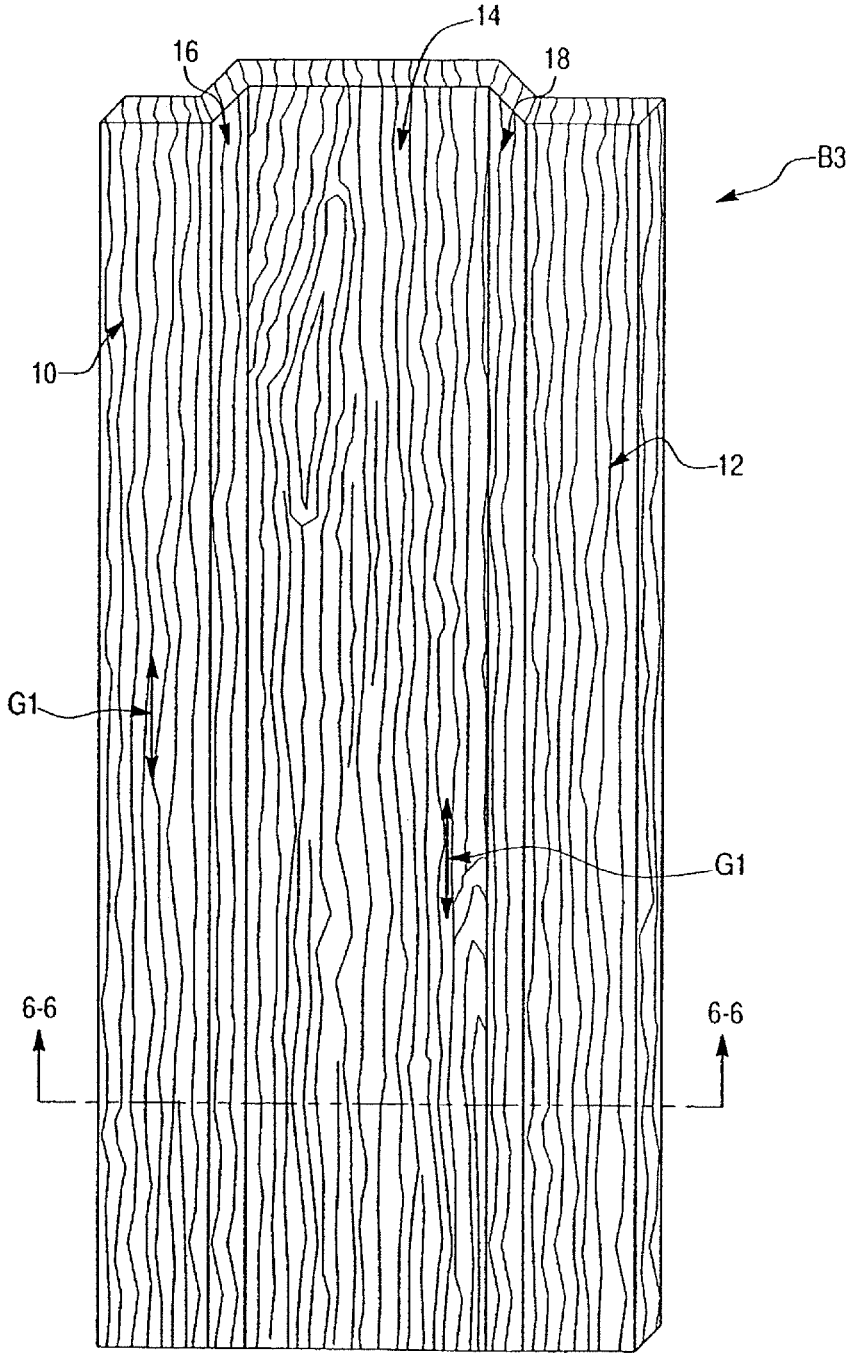
FIG. 5 is an elevational view of a universal door skin blank having a decorative layer according to the present invention.
Figure 6:
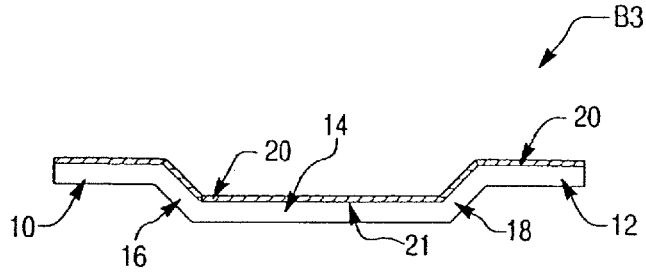
FIG. 6 is a cross-sectional view taken along the line 6-6 of FIG. 5 and viewed in the direction of the arrows.

As best shown in FIGS. 5-6, blank B3 may include a decorative layer 20, such as a veneer, foil, paper overlay, or the like. Decorative layer 20 may be finished or unfinished, or otherwise patterned. Decorative layer 20 is secured to surface 21 which is to be exteriorly disposed of blank B3, as best shown in FIG. 6. Preferably, decorative layer 20 is compressed onto and secured to blank B3 during formation of blank B. For example, decorative layer 20 may be bonded to an MDF blank during post-form compression. We have found that decorative layer 20 should be adhesively secured to blank B3, preferably through the use of a thermally activated adhesive or resin applied to exterior surface 21 of blank B3, the decorative layer 20, or incorporated into decorative layer 20. Therefore, decorative layer 20 may be bonded to blank B3 at the same time blank B3 is being molded into the desired contour. If a veneer is used, a layer of adhesive is applied to either the veneer surface to be bonded, or the surface 21 of blank B3 to be secured to the veneer. Similarly, if a paper overlay is used, a layer of adhesive may be applied to either the surface of the paper overlay to be bonded or to the surface 21 of blank B3. Alternatively, resin impregnated paper may be used.

Decorative layer 20 preferably has a wood grain pattern and characteristics running parallel to stiles 10, 12, as best shown in FIG. 5 by arrows G1. However, it is understood that decorative layer 20 may have any desired pattern or texture. It should also be understood that blank B need not have any decorative layer 20, as best shown in FIG. 1. For example, a high quality blank B may be used which is painted or colored after formation. Therefore, decorative layer 20 is optional. In addition, a die set may include an embossed or textured pattern in the die molds, producing a blank having a textured surface ingrained directly into the wood composite material, instead of using decorative layer 20.

Figure 8:
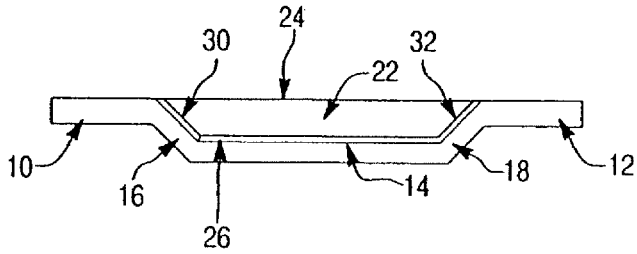
FIG. 8 is a cross-sectional view taken along the line 8-8 of FIG. 7 and viewed in the direction of the arrows.
Figure 7:
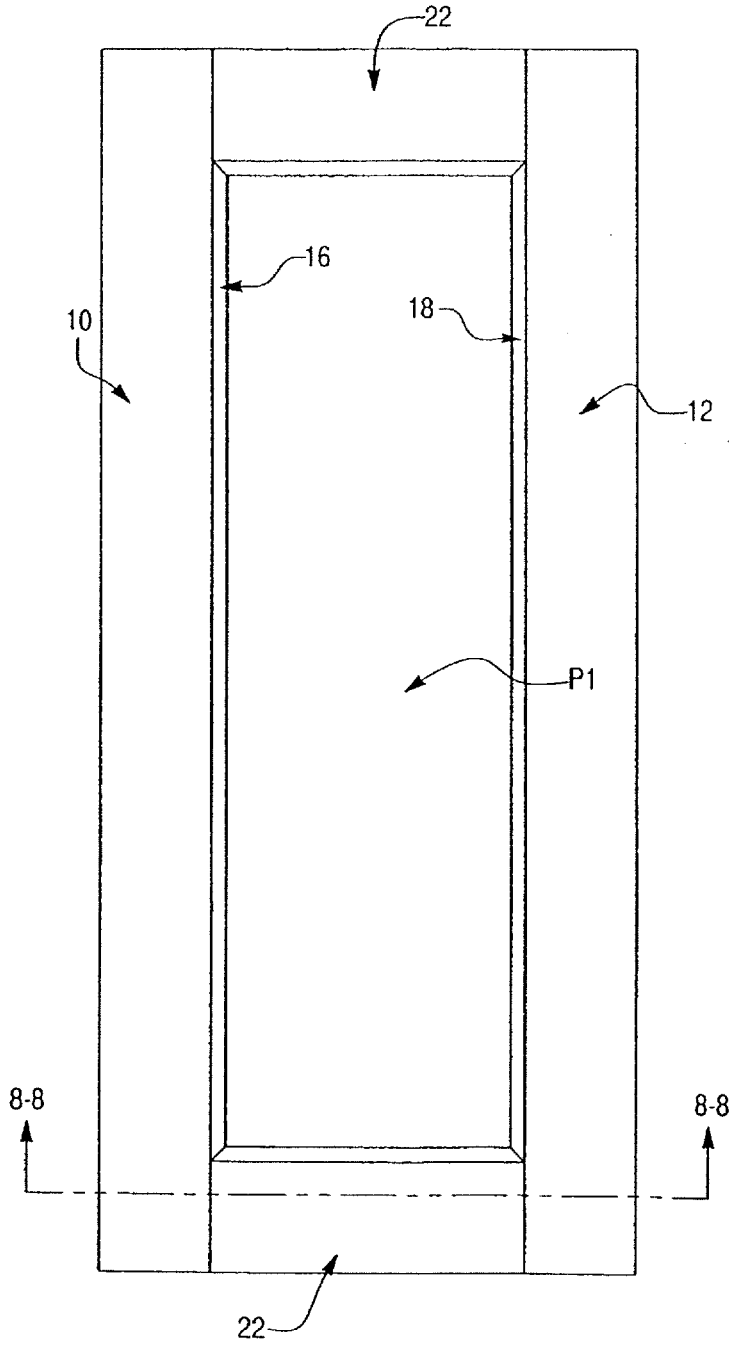
FIG. 7 is an elevational view of a universal door skin blank with rails secured thereon according to the present invention.

As best shown in FIGS. 7 and 8, at least two rails 22 may be secured to blank B at opposite ends of planar portion 14. Rails 22 are separately formed, and may be post-formed MDF, solid wood cut to the desired size and shape, or a molded wood composite formed to the desired size and shape. Each one of rails 22 has an exterior major surface 24, and an interior major surface 26 for being secured to planar portion 14, as best shown in FIG. 8. Each one of rails 22 further comprise oppositely disposed angled ends 30, 32. Angled ends 30, 32 are complementary to and form a fit with interfaces 16, 18, respectively. Therefore, if interfaces 16, 18 are formed at an angle of 45°, angled ends 30, 32 are also formed at an angle of 45°, so that rails 22 are precisely secured to planar portion 14 and interfaces 16, 18. In addition, it is easier to form a fit between interfaces 16, 18 and angled ends 30, 32 with an angle of 45°.

A conventional bead and cove configuration of a door having separately formed rails requires precise alignment of the interface at which rails are secured. In the present invention, the 45° angle of angled ends 30, 32 ensures a secure fit, even if exterior surface 24 of rail 22 is not flush with stiles 10, 12. Angled ends 30, 32 are formed to have an inverse configuration relative to interfaces 16, 18, respectively. Although exterior surface 24 of rail 22 is preferably flush and coplanar with stiles 10, 12, as shown in FIG. 8. It is understood that exterior surface 24 may also be recessed, or positioned slightly above stiles 10, 12. It may be preferred by the customer that rails 22 be slightly recessed. Preferably, rails 22 are adhesively secured to planar portion 14.

Figure 9:
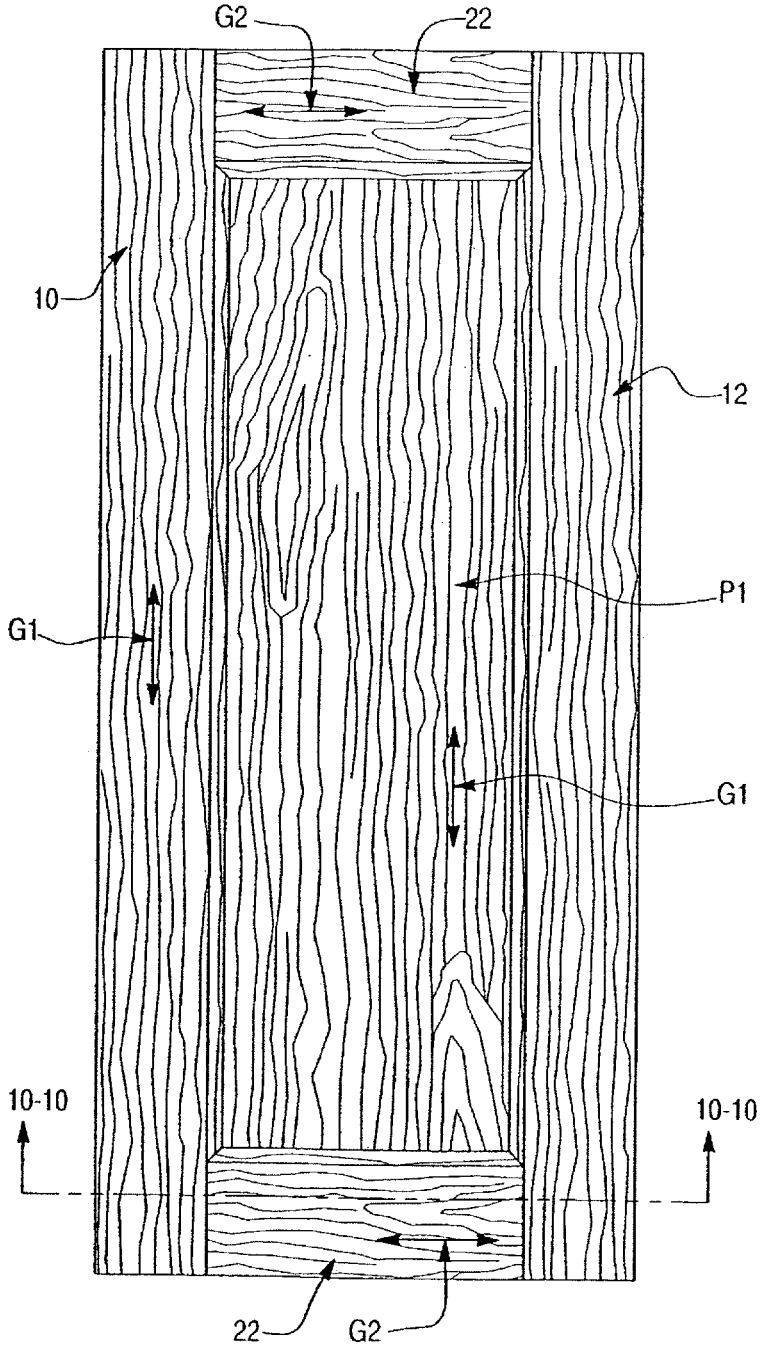
FIG. 9 is an elevational view of a universal door skin blank having a decorative layer and with rails secured thereon according to the present invention.
Figure 10:
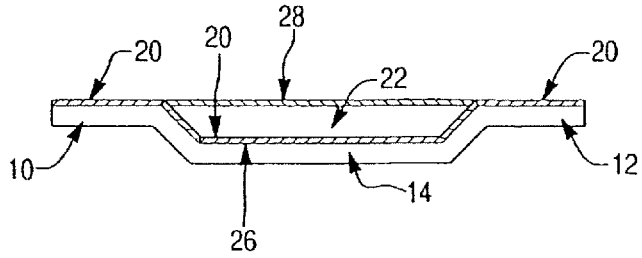
FIG. 10 is a cross-sectional view taken along line 10-10 of FIG. 9 and viewed in the direction of the arrows.

A decorative layer 28 may also be secured to rails 22, as best shown in FIGS. 9 and 10. Preferably, decorative layer 28 has the same pattern as decorative layer 20. However, the pattern or species covering rails 22 may differ from the pattern or species covering blank B. The grain of decorative layer 28 runs parallel to rails 22, as best shown by arrows G2 in FIG. 9. The grain of decorative layer 20 runs parallel to stiles 10, 12. Therefore, the orientation and characteristics of the wood grain pattern of decorative layer 20 on stiles 10, 12 is perpendicular to the orientation and characteristics of the wood grain pattern of decorative layer 28 on rails 22, as best shown by arrows G1 and G2 in FIG. 9.

Interior major surface 26 of rails 22 may be secured directly to decorative layer 20, as best shown in FIG. 10. Preferably, rails 22 are secured to decorative layer 20 covering planar portion 14 so that decorative layer 28 on rails 22 is flush and coplanar with decorative layer 20 covering stiles 10, 12. However, it is to be understood that rails 22 may also be recessed from stiles 10, 12.

Universal door skin blank B may be formed to any desired length, and subsequently cut to a desired size. Hence, a single blank may be used for doors of essentially any size. Alternatively, because of the uniform shape of blank B, the dies of the mold can accommodate a blank having a length less than the corresponding length of the dies. After blank B is cut to size, rails 22 may be secured to planar portion 14, simulating a panel P1 disposed between stiles 10, 12, as best shown in FIGS. 7 and 9. The length of P1 is therefore variable, depending on where rails 22 are secured on planar portion 14 of blank B. Because planar portion 14 extends the entire length of blank B, and maintains its width the entire length of blank B, rails 22 may be positioned as desired, and are not confined to specific receiving surfaces as in some prior art designs. In this way, manufacturing and inventory costs are greatly reduced because only one mold die set is required for each width of universal door skin blank B, which may thereafter be transformed into various panel configurations or lengths by securing two or more rails as described herein. The necessity of a separate die set for each length blank B is eliminated. Although the width of blank B is predetermined during formation, other features, such as length and rail placement, may be achieved by modification of blank B.

Figure 12:
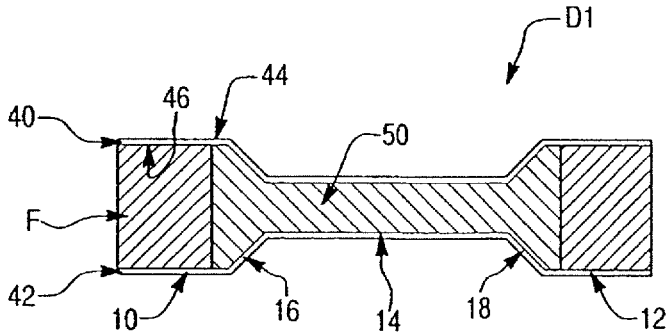
FIG. 12 is a cross-sectional view taken along line 12-12 of FIG. 11 and viewed in the direction of the arrows.
Figure 11:
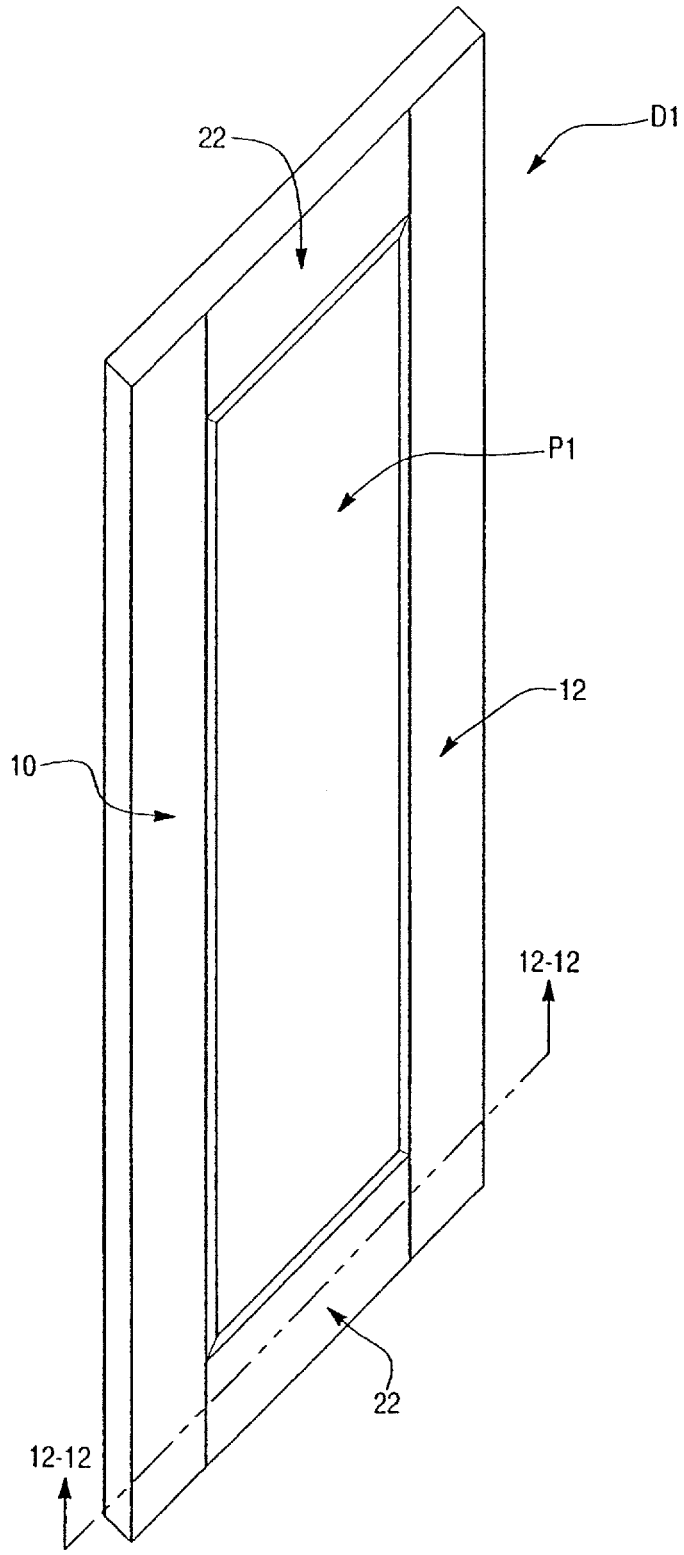
FIG. 11 is a perspective view of a door having two rails.
Figure 13:
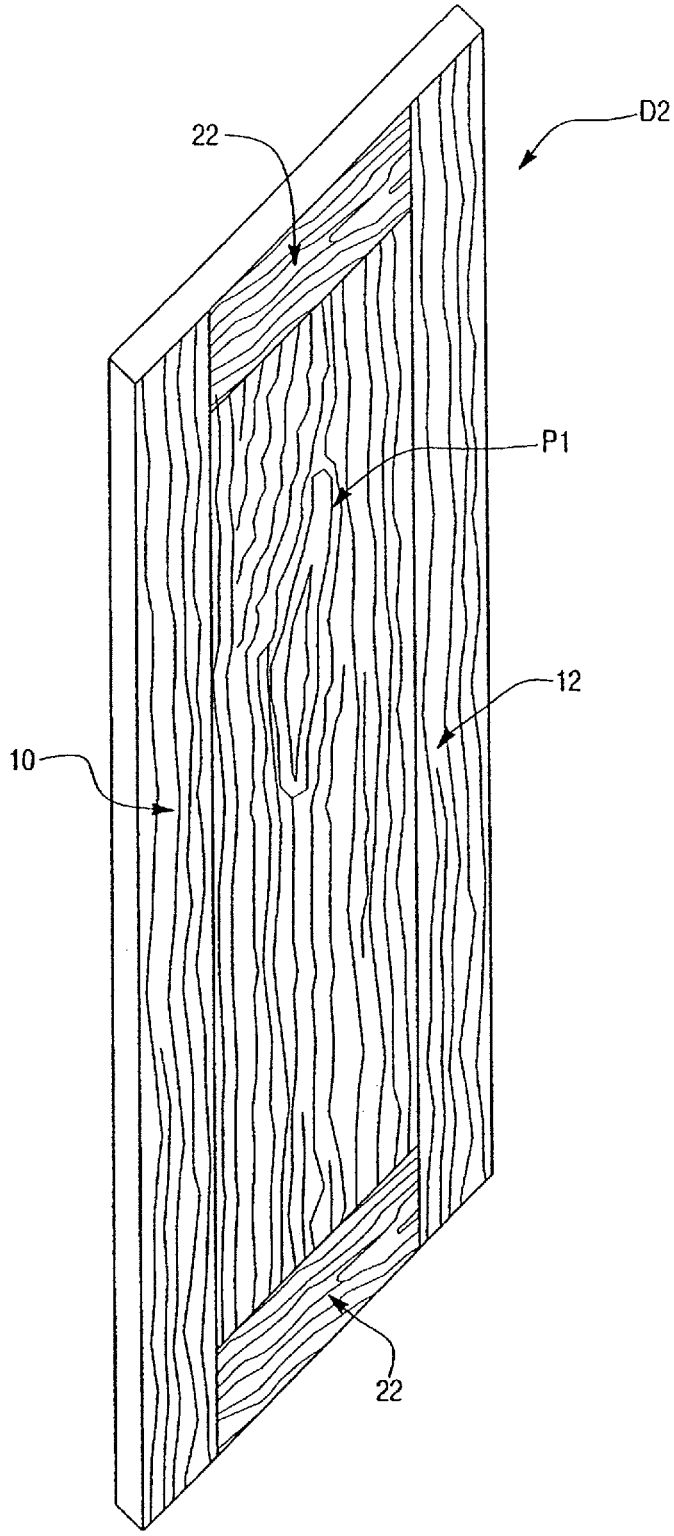
FIG. 13 is a perspective view of a door having a decorative layer and having two rails.

As best shown in FIGS. 11-12, door D1 includes a peripheral frame F, preferably formed of wood, having oppositely disposed sides, as known in the art. First and second door skins 40, 42 are provided. Each skin has an exterior side 44 and an interior side 46. Each one of interior sides 46 is adhesively secured to a corresponding side of frame F, such as through the use of polyvinyl acetate or the like. At least one of door skins 40, 42 is formed to have spaced stiles 10, 12 and planar portion 14, as described above. Rails 22 simulate a panel P1. Door D1 may have identical door skins 40, 42 secured to the opposing sides of the frame F, as best shown in FIG. 12. As known in the art, a filler 50 or honeycomb material may be disposed between the first and second skins 40, 42, or the door may have a solid core. It is to be understood that decorative layers 20, 28 may also be included on at least one of skins 40, 42, to form door D2 having a wood grain pattern, as best shown in FIG. 13. Alternatively, a textured pattern may be molded into the wood composite forming blank B, thereby eliminating the need for decorative layer 20.

Any number of door configurations may be achieved with universal door skin blank B (or B1-B3). After blank B is formed, any number or configuration of rails 22 may be secured to planar portion 14 (or decorative layer 20). Therefore, only one die set for blank B is necessary, reducing manufacturing and inventory costs. Pursuant to consumer preference, universal door skin blank B may be cut to size and rails 22 quickly secured. Thus, a wide range of door configurations and lengths are achieved with one mold for blank B, thereby eliminating the expense of multiple die sets for each configuration.

Figure 14:
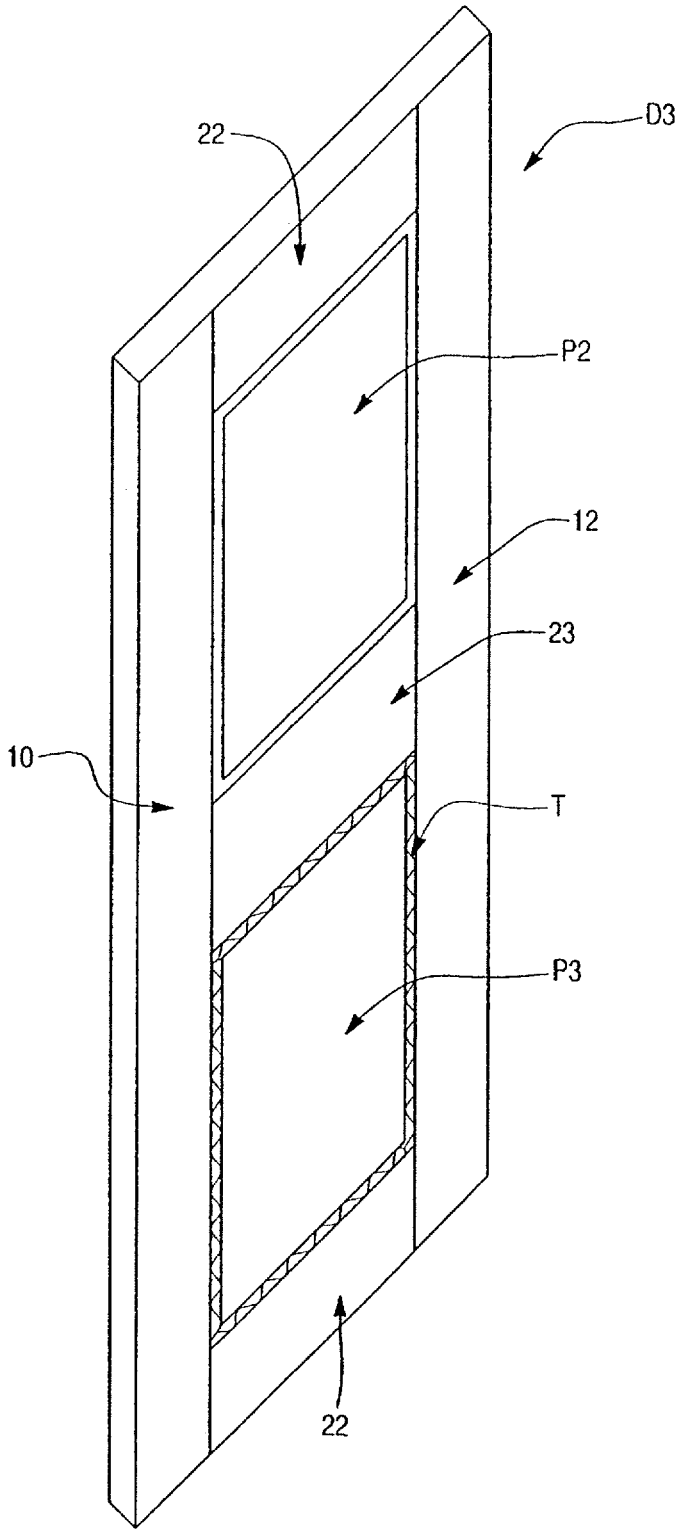
FIG. 14 is a perspective view of a door having three rails.

For example, doors D1 and D2 include two rails 22 secured at opposite ends of planar portion 14 to provide a one-panel door simulation, as best shown in FIGS. 11 and 13. As best shown in FIG. 14, door D3 includes rails 22 at opposite ends of planar portion 14, and an intermediate rail 23, which is secured to planar portion 14, thus simulating two panels P2 and P3, respectively. It is to be understood by one skilled in the art that any number of rails 22 may be secured to planar portion 14, or decorative layer 20 as described above. Moreover, it is to be understood that intermediate rail 23, which may have the same size and configuration of rails 22, may be secured anywhere desired on planar portion 14 pursuant to customer choice, thereby varying the size of panels P2 and P3. Rails 22, 23 may be positioned anywhere on planar portion 14, because planar portion 14 extends the entire width between stiles 10, 12 and length of blank B. Because there is no raised infill panel, blank B may be utilized regardless of the design chosen. Mold trim T may also be secured to interfaces 16, 18 (or 26", 28") surrounding P2 and/or P3, as best shown in FIG. 14.

Figure 15:
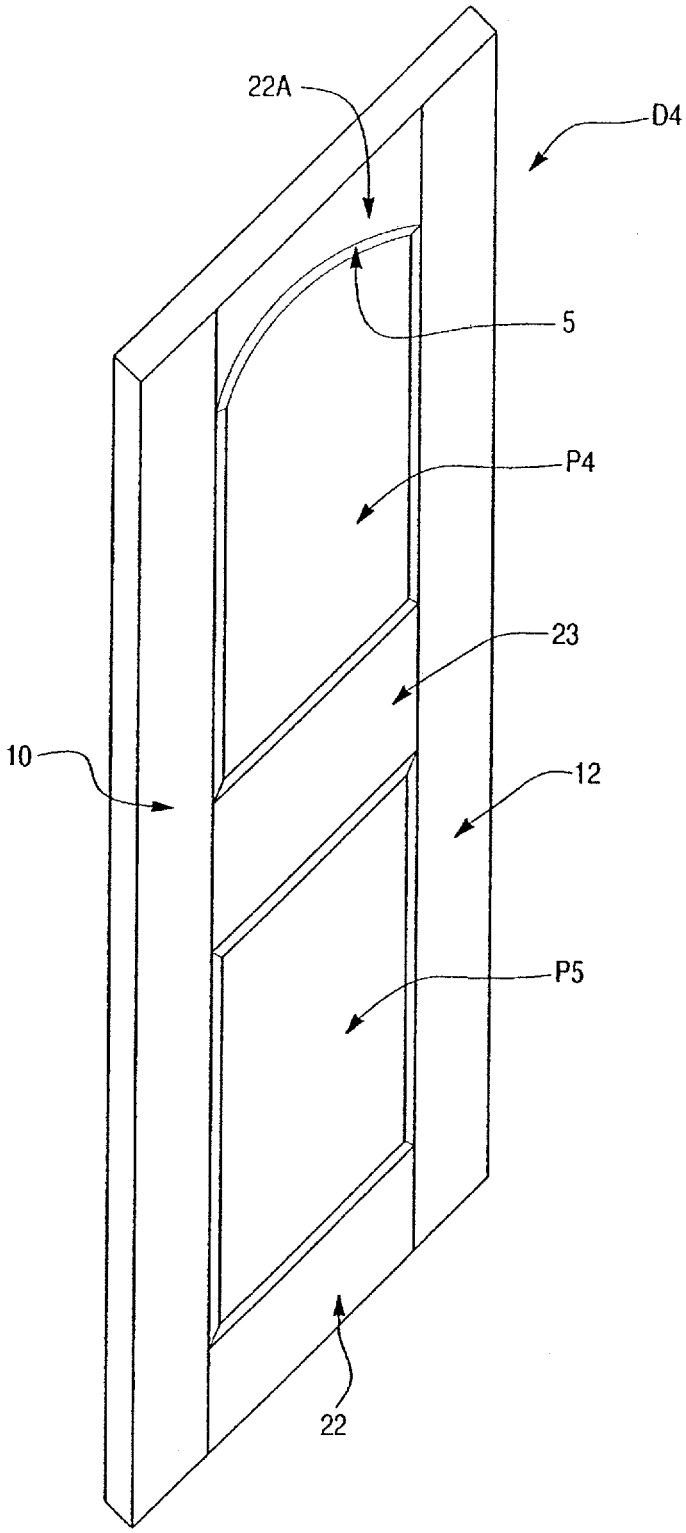
FIG. 15 is a perspective view of a door having a curved rail.
Figure 16:
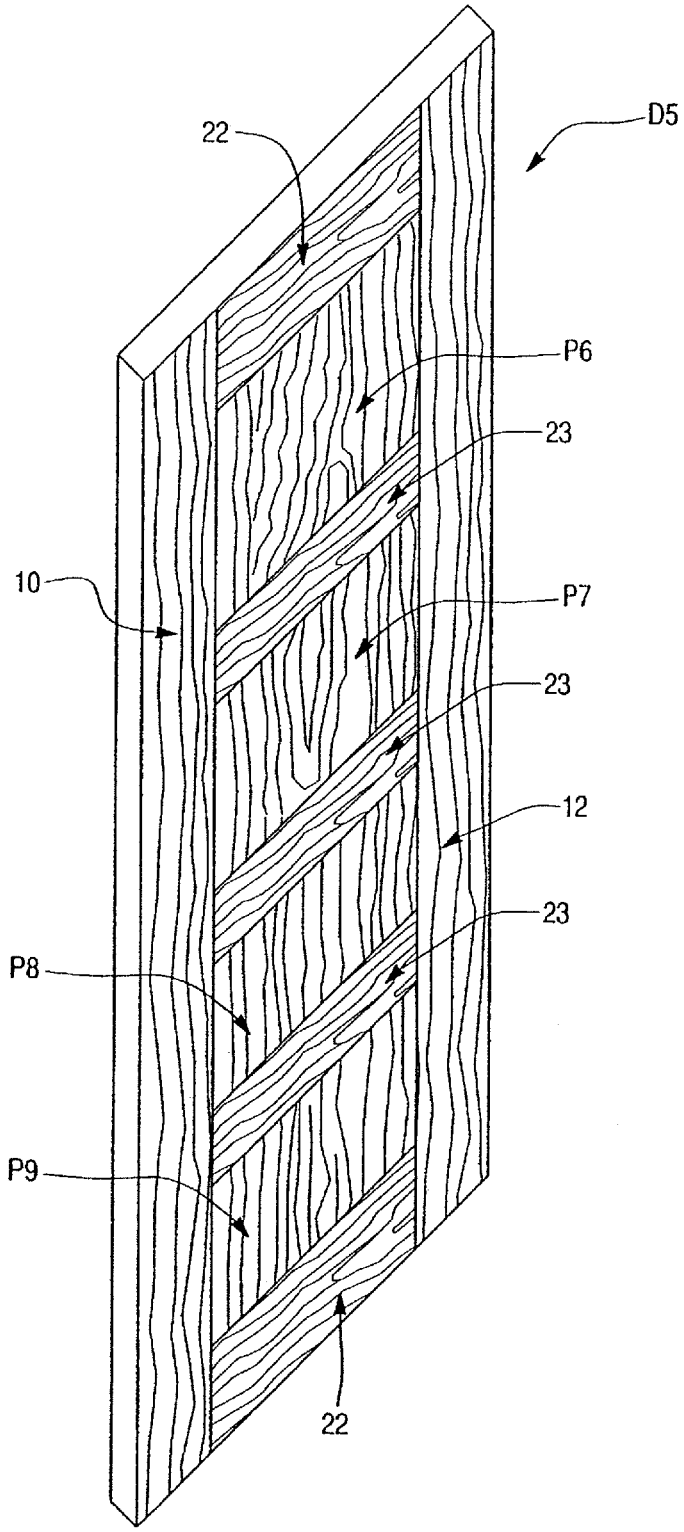
FIG. 16 is a perspective view of a door having five rails.

In another configuration, door D4 includes a curved upper rail 22A secured to planar portion 14, one rail 22, and intermediate rail 23, as best shown in FIG. 15. Curved rail 22A includes a curved side S extending from opposite ends. Because planar portion 14 is flat, rails 22, 23 and/or 22A may be positioned and configured as desired. Rails 22, 22A and 23 are secured to simulate two panels, P4 and P5. However, it should be understood that any number of panels may be simulated by securing additional rails 22 to planar portion 14. For example, door D5 includes rails 22 at opposite ends of planar portion 14, and three intermediate rails 23, as best shown in FIG. 16. Rails 22 and intermediate rails 23 simulate four panels P6, P7, P8, and P9.

Prior art methods including a raised infill panel and predefined receiving surfaces limit the configuration and shape of the rails used. In the present invention, the mold producing blank B may be used for various door configurations and lengths.

Figure 17:
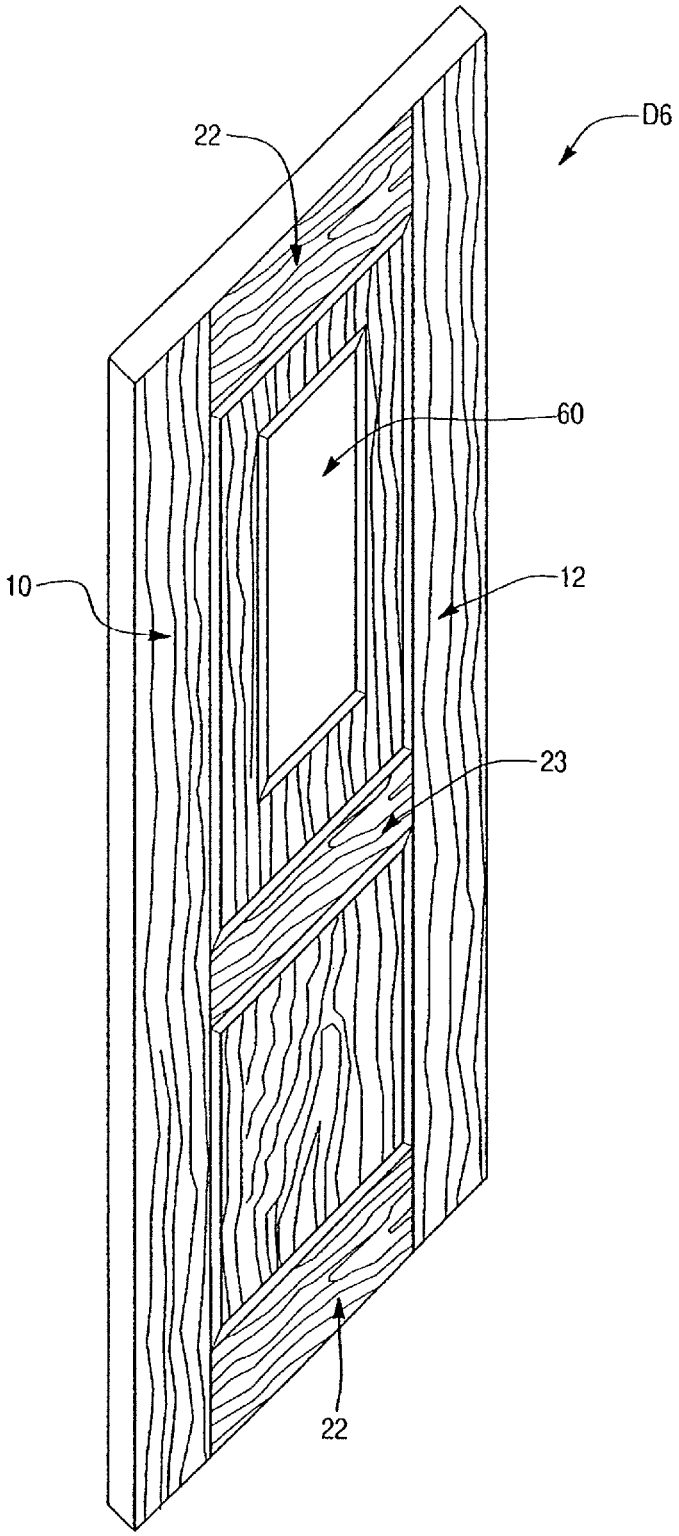
FIG. 17 is a perspective view of a door having three rails and a panel.

In another embodiment of the present invention, door D6 includes at least one panel 60 adhesively secured to decorative layer 20 covering planar portion 14 (or directly to planar portion 14, as noted above), as best shown in FIG. 17. Panel 60 may have a decorative layer or pattern, as described for rails 22, or have a plain appearance if desired by the consumer. If a wood grain pattern is desired on panel 60, the pattern may be oriented as desired. Thus, the orientation of the wood grain pattern on panel 60 may be different than the orientation of the wood grain 20, 28 on stiles 10, 12 and/or rails 22, or panel 60 may simply have a plain surface. The panel 60 may alternatively be a decorative element, such as a logo, design, or like desired pattern applied to planar portion 14, either with decorative layer 20 or some other decorative medium.

Figure 18:
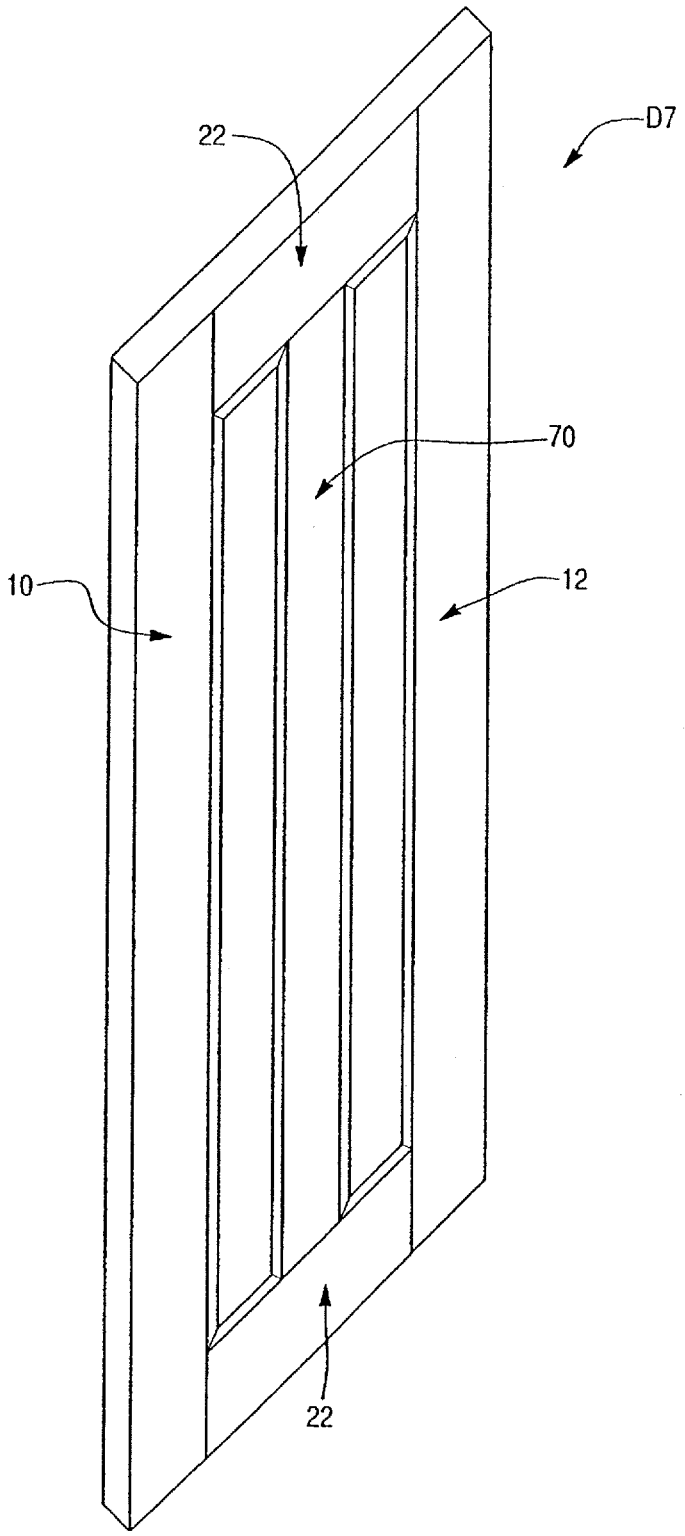
FIG. 18 is a perspective view of a door having two rails and an intermediate stile.

As best shown in FIG. 18, door D7 includes rails 22 secured to opposite ends of planar portion 14, and intermediate stile 70. Similar to panel 60, intermediate stile 70 may be adhesively secured to planar portion 14 (or decorative layer 20 covering planar portion 14), and extends parallel to, and intermediate from, stiles 10, 12. Thus, intermediate stile 70 simulates a third stile. Intermediate stile 70 may also include a decorative layer or pattern, as described above.

Although the present invention has been explained with reference to a door skin and a door, it is to be understood that the disclosed invention is also applicable to other formed panels, such as a wainscot panel, or other doors, such as cabinet or furniture doors. It will be apparent to one of ordinary skill in the art that various modifications and variations can be made in construction or configuration of the present invention without departing from the scope or spirit of the invention.

We claim as follows:

1. A method of producing a universal door skin blank, comprising the steps of:

providing a die set having an upper die spaced from a lower die, the dies creating a forming chamber defining first and second spaced stiles lying on a first plane, and a flat planar portion lying on a second plane spaced from the first plane, the flat planar portion being integral with, disposed between, and having a length equal to the length of said stiles;

disposing a flat substrate between the upper and lower dies, wherein the flat substrate comprises an exterior side and an interior side;

providing a decorative layer on the exterior side of the flat substrate; and compressing the flat substrate and the decorative layer using heat and pressure to form a blank having first and second molded, spaced stiles, a flat planar portion disposed between the stiles, said flat planar portion lying on a single plane spaced from the plane of the stiles, and an interface portion disposed between and contiguous with the stiles and the flat planar portion and extending an entire length of said blank, said planar portion having a length equal to the length of the stiles and extending uninterruptedly between the stiles, wherein the decorative layer is bonded to the flat substrate during compression.

2. The method of claim 1, including the step of selecting a substrate having a length less than the length of the die set.

3. The method of claim 1, including the step of cutting the compressed blank to a selected length, wherein the selected length is less than the length of the die set.

4. The method of claim 1, including the step of providing at least one die having a textured surface for producing a pattern on the blank.

5. The method of claim 1, wherein the decorative layer comprises at least one of a veneer, foil and a paper overlay.

6. The method of claim 1, including the step of selecting the substrate from the group consisting of particleboard, hard board, and medium density fiberboard.

7. A method of producing a door, comprising the steps of:

providing a peripheral door frame having oppositely disposed sides;

providing first and second flat wood composite blanks having an exterior side and an interior side;

forming each the flat wood composite blanks to have molded spaced stiles lying on a first plane, a flat planar portion extending between and having a length equal to the length of the stiles for each of the flat wood composite blanks, the flat planar portion lying on a second plane spaced from said first plane, the flat planar portion extending the length of and uninterruptedly between the stiles to provide a single surface in a single plane, and an interface portion disposed between and contiguous with the stiles and the flat planar portion, said interface portion extending an entire length of said blank, wherein said spaced stiles, said flat planar portion, and said interface portion are forming simultaneously in a press;

bonding a decorative layer to the exterior side of the flat wood composite blank simultaneously with forming said spaced stiles, said flat planar portion, and said interface portion;

securing the interior sides of each of the flat wood composite blanks to one of the opposite sides of said door frame after said step of forming so that the door frame is sandwiched between the first and second flat wood composite blanks;

forming at least two rails, each one of the rails having an exterior surface and an interior surface; and securing the interior surface of the rails onto the flat planar portion at any desired position along the length thereof, whereby said interior surface is in continuous contact with said flat planar portion at said any desired position.

8. The method of claim 7, including the step of securing the rails to opposite ends of the flat planar portion.

9. The method of claim 7, wherein the decorative layer comprises at least one of a veneer, foil and a paper overlay.

10. The method of claim 7, including the step of securing one of a veneer, foil and paper overlay to the exterior surface of the rails.

11. The method of claim 7, including the step of selecting the wood composite blank from the group consisting of particleboard, hard board, and medium density fiberboard.

12. The method of claim 7, comprising the further steps of:

defining at least one panel by securing the rails onto the flat planar portion;

adhesively securing the interior surface of the rails to the decorative layer associated with the flat planar portion of the flat wood composite blank.

13. The method of claim 12, further comprising the step of securing an additional decorative layer to the exterior surface of the panel.

14. The method of claim 12, including the step of post-forming the panel.

15. The method of claim 7, including the step of securing trim to said interface portions.

16. The method of claim 7, wherein the rails have both a first end and a second end angled to compliment the interface portions.

17. The method of claim 7, including the step of trimming at least one of the wood composite blanks prior to securing it to the frame.

18. The method of claim 7, including the step of placing a filler between the first and second wood composite blanks when they are attached to the frame.

19. The method of claim 7, including the step of securing at least one panel to the flat planar portion.

* * * * *